US011100799B2

(12) United States Patent
Hallmann

(10) Patent No.: US 11,100,799 B2
(45) Date of Patent: Aug. 24, 2021

(54) METHOD FOR OPERATING A SYSTEM FOR CHECKING PARKING PROBABILITIES, SYSTEM, COMPUTER PROGRAM AND COMPUTER PROGRAM PRODUCT

(71) Applicant: Bayerische Motoren Werke Aktiengesellschaft, Munich (DE)

(72) Inventor: Carl Hallmann, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 16/876,823

(22) Filed: May 18, 2020

(65) Prior Publication Data

US 2020/0279484 A1 Sep. 3, 2020

Related U.S. Application Data

(63) Continuation of application No. PCT/EP2018/080225, filed on Nov. 6, 2018.

(30) Foreign Application Priority Data

Nov. 27, 2017 (DE) ..... 10 2017 221 180.6

(51) Int. Cl.
*G08G 1/14* (2006.01)
*G08G 1/01* (2006.01)

(52) U.S. Cl.
CPC ..... *G08G 1/147* (2013.01); *G08G 1/0129* (2013.01)

(58) Field of Classification Search
CPC ..... G08G 1/147; G08G 1/0129
See application file for complete search history.

(56) References Cited

U.S. PATENT DOCUMENTS 9,747,797 B1 * 8/2017 Ghosh ..... G08G 1/143
2007/0208494 A1 9/2007 Chapman et al.
(Continued)

FOREIGN PATENT DOCUMENTS

DE 10 2012 201 472 A1 8/2013
DE 10 2013 211 632 A1 12/2014
(Continued)

OTHER PUBLICATIONS

International Search Report (PCT/ISA/210) issued in PCT Application No. PCT/EP2018/080225 dated Feb. 21, 2019 with English translation (six (6) pages).
(Continued)

*Primary Examiner* — Hongmin Fan
(74) *Attorney, Agent, or Firm* — Crowell Æ Moring LLP

(57) ABSTRACT

A method for operating a system for checking parking probabilities is specified. The method involves the backend being provided with a parking probability q that needs to be checked for at least one parking segment within a prescribed area at a prescribed test time. The backend is further provided with parking information representative of a number N of parking spaces within the parking segment. A proportion p of the vehicles associated with the system from a total number of vehicles within the prescribed area is ascertained. A K number of vehicles associated with the system that are parking in the respective parking segment at the test time is ascertained. A K number of vehicles associated with the system that are parking in the respective parking segment at the test time are ascertained. A proportion p is used a basis for ascertaining whether the parking probability q is plausible.

20 Claims, 2 Drawing Sheets

(56) References Cited

U.S. PATENT DOCUMENTS

| | | | | |
|---|---|---|---|---|
| 2013/0257632 | A1 | 10/2013 | Harber et al. | |
| 2014/0062727 | A1* | 3/2014 | Aivas | G08G 1/146 340/932.2 |
| 2014/0340242 | A1 | 11/2014 | Belzner et al. | |
| 2015/0009047 | A1* | 1/2015 | Ashkenazi | G08G 1/147 340/932.2 |
| 2015/0161890 | A1* | 6/2015 | Huntzicker | G08G 1/147 340/932.2 |
| 2016/0358473 | A1* | 12/2016 | Scofield | G08G 1/143 |
| 2016/0371978 | A1* | 12/2016 | Nordbruch | G08G 1/14 |

FOREIGN PATENT DOCUMENTS

| | | | |
|---|---|---|---|
| DE | 10 2014 209 453 | A1 | 11/2015 |
| EP | 2 975 593 | A1 | 1/2016 |

OTHER PUBLICATIONS

German-language Written Opinion (PCT/ISA/237) issued in PCT Application No. PCT/EP2018/080225 dated Feb. 21, 2019 (seven (7) pages).

German-language Search Report issued in German Application No. 10 2017 221 180.6 dated Oct. 24, 2018 with partial English translation (11 pages).

* cited by examiner

METHOD FOR OPERATING A SYSTEM FOR CHECKING PARKING PROBABILITIES, SYSTEM, COMPUTER PROGRAM AND COMPUTER PROGRAM PRODUCT

CROSS REFERENCE TO RELATED APPLICATIONS

This application is a continuation of PCT International Application No. PCT/EP2018/080225, filed Nov. 6, 2018, which claims priority under 35 U.S.C. § 119 from German Patent Application No. 10 2017 221 180.6, filed Nov. 27, 2017, the entire disclosures of which are herein expressly incorporated by reference.

BACKGROUND AND SUMMARY OF THE INVENTION

The disclosed subject matter relates to a method for operating a system for checking parking probabilities and to a corresponding system, computer program, and computer program product.

With increasing population density and vehicle density, the problem of searching for a parking space is growing, particularly in city centers. The likelihood of finding a parking space at a destination is currently based on experience.

The disclosed subject matter describes a method for operating a system for checking parking probabilities, and a corresponding system, computer program and computer program product that contributes or contribute to a precise prediction that enables or enable a more efficient search for a suitable parking space near to a destination for vehicle drivers.

The disclosed subject matter relates to a method for operating a system for checking parking probabilities. The system comprises a plurality of vehicles and a backend. The method involves the backend being provided with a parking probability q to be checked for at least one parking segment within a predetermined area at a predetermined time of testing. Furthermore, the backend is provided with parking information for each parking segment. The parking information is representative of a number N of parking spaces within the parking segment. Moreover, the method involves determining a proportion p of vehicles associated with the system from a total number of vehicles within the predetermined area and a K number of vehicles associated with the system. The K number of vehicles are parked in the respective parking segment at the time of testing. Finally, it is determined whether the parking probability q is plausible, depending on the parking information, the K number of vehicles associated with the system that are parked in the respective parking segment at the time of testing, and the determined proportion p.

Advantageously, parking probabilities q can be checked for data collection independently of a service or provider with the proposed method. By using parking probabilities q of this type, further data sources are only optional in order to test provided information in a different manner and in a manner that cannot be reproduced by the data collection service or data collection provider.

The method according to the disclosed subject matter particularly advantageously contributes to delivering results that are statistically unambiguous. In particular, it contributes to improving estimated parking probabilities and the quality of services derived therefrom.

The vehicles associated with the system are coupled with the backend for signaling. In this context, the vehicles have a communication interface, such as a mobile radio module, by way of example.

The vehicles associated with the system can be those vehicles, measured against the total number of vehicles within the predetermined area, which are produced by the same manufacturer and are equipped with a communication interface of this type, for example.

The total number of vehicles within the predetermined area and/or the proportion p of vehicles associated with the system within the predetermined area may be determined from a registration statistic, for example, such as that of the Federal Motor Transport Authority.

A regional division of the Federal Motor Transport Authority may be considered as a predetermined area, for example. Here and in the following, the predetermined area describes a county in which the vehicle has been authorized or registered, by way of example.

Areas that have spaces for one or a plurality of vehicles are described here and in the following in each case as a parking segment, regardless of whether or not these spaces are occupied. A parking segment can comprise one or a plurality of street sections. By way of example, the space(s) is/are adjacent to or is/are part of the respective street sections. The spaces can also be described as parking spaces.

The vehicles associated with the system can have a locating module, for example, in order to identify the parking segment in which they have been parked. In order to determine the K number of vehicles that are parked in the respective parking segment and are associated with the system, a data exchange takes place by way of example at the time of testing between the backend and the vehicles associated with the system. Alternatively or additionally, the vehicles associated with the system send their parking position to the backend as soon as they have been shifted into a parking state.

In an advantageous configuration in accordance with the first aspect, the checked parking probability q is used in a navigation system for a vehicle. By way of example, the checked parking probability q serves to indicate parking possibilities and/or to provide route guidance to a parking possibility.

In a further advantageous configuration in accordance with the first aspect, the parking information comprises historical parking data.

In a further advantageous configuration in accordance with the first aspect, an upper limit C is determined, in the case of which a probability P that a K' number of vehicles associated with the system that are parked in the respective parking segment at the time of testing exceeds the upper limit C is less than or equal to a predetermined threshold value $\alpha$, depending on the parking information and the determined proportion p. It is then determined whether the parking probability q is plausible, depending on the upper limit C and the K number.

The K number of vehicles associated with the system is the actually recorded number of vehicles that are parked in the respective parking segment at the time of testing. However, the K' number describes hypothetical vehicles that are taken into account in order to determine the probability P.

In a further advantageous configuration in accordance with the first aspect, the probability P that the K' number of vehicles associated with the system that are parked in the respective parking segment at the time of testing exceeds the upper limit C is calculated by the following formula:

$$P(K' > C \mid N, p, q) = \sum_{c=C+1}^{N} P(K' = c \mid N, p, q) = \sum_{c=C+1}^{N} \binom{N}{c} (pq)^c (1 - pq)^{N-c}$$

In a further advantageous configuration in accordance with the first aspect, the upper limit C is calculated by the following formula:

$$C = \min\{c \in \{1,2, \ldots ,N\} : P(K' > c \mid N,p,q) \leq \alpha\}$$

In a further advantageous configuration in accordance with the first aspect, depending on the parking information and the determined proportion p, a probability distribution $\tilde{Q}$ is determined, which is representative of an estimated distribution of the actual parking probability $\bar{q}$. Consequently, depending on the estimated probability distribution $\tilde{Q}$ and the determined K number, an adjusted probability distribution $\overline{Q}$ is determined according to Bayes' theorem. Finally, depending on the adjusted probability distribution $\overline{Q}$, at least one confidence interval is determined where the parking probability q is evaluated as plausible.

In accordance with a second aspect, the present subject matter relates to a system for checking parking probabilities, comprising a plurality of vehicles and a backend. The system is designed to carry out the method in accordance with the first aspect.

In accordance with a third aspect, the present subject matter relates to a computer program for checking parking probabilities. The computer program is designed to carry out a method in accordance with the first aspect when it is being executed on a data processing device.

In accordance with a fourth aspect, the present subject matter relates to a computer program product comprising executable program code. The program code executes the method in accordance with the first aspect when it is being executed by a data processing device.

Other objects, advantages and novel features of the present invention will become apparent from the following detailed description of one or more preferred embodiments when considered in conjunction with the accompanying drawings.

BRIEF DESCRIPTION OF THE DRAWINGS

Elements with the same structure or function are provided with the same reference numbers in all figures.

DETAILED DESCRIPTION OF THE DRAWINGS

The underlying idea of the present subject matter is to use a system comprising a relatively large fleet of observed vehicles to test whether a parking probability that is provided to the system is correct at a specific point in time and for a specific street segment.

Figure 1:
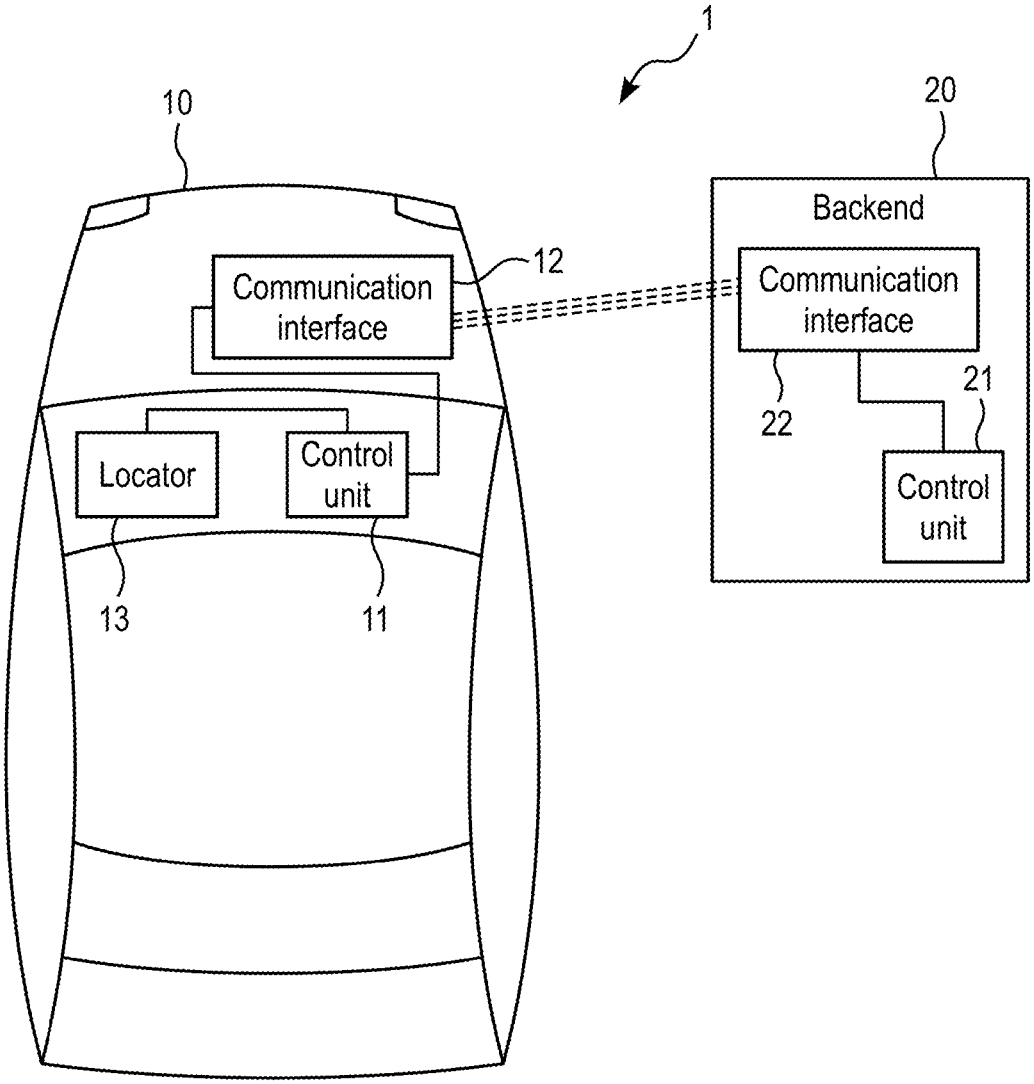
FIG. 1 shows a system according to the disclosed subject matter for checking parking probabilities.

FIG. 1 shows a system 1 of this type that comprises a plurality of vehicles 10 (only one vehicle 10 is depicted here, in an exemplary manner) and a backend 20. The vehicle 10 has a control unit 11 as well as a communication interface 12 and a locator 13 that are connected to the control unit 11 for signaling. The backend 20 likewise has a control unit 21, which is coupled with a communication interface 22 associated with the backend 20 for signaling. A data exchange between the vehicle 10 and the backend 20 is made possible via the communication interface 12, 22, as indicated by the dashed lines.

In order to test whether a parking probability provided to the system 1 is correct, the idea is to compare the number of observed vehicles 10 that are parked in a parking segment at a given point in time with the parking probability that has to be tested. If and where the vehicle 10 is parked may be determined by the locator 13, for example. Alternatively or additionally, further indications can be taken into account in this respect, such as a park position of the transmission, by way of example. If a large number of parked vehicles 10 are observed relative to the number of available parking spaces in the parking segment when testing the parking probability, this suggests that the parking probability must be high in the parking segment. This notion may be formalized by a statistical test.

A system or a method of this type may be used, inter alia, as a legal basis if data sets or so-called "life services" which provide parking probabilities are acquired.

Figure 2:
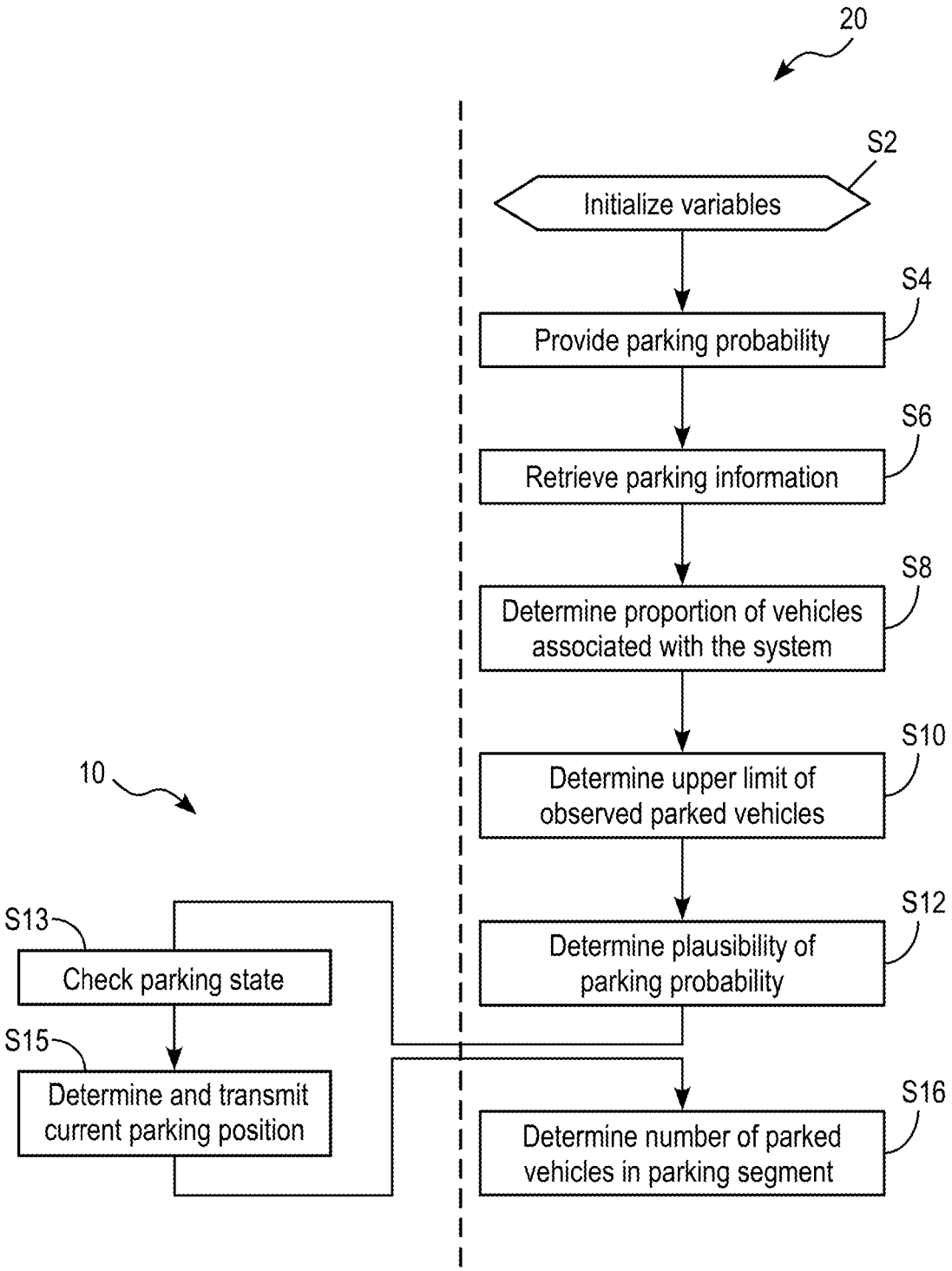
FIG. 2 shows a flow diagram of a method according to the disclosed subject matter for checking parking probabilities.

In this context, the control units 11, 21 are each supplied with a data and program memory where a program is saved, and which is explained in greater detail hereinafter using the flow diagram from FIG. 2. Program steps which are executed in the vehicle are provided with odd reference numbers and are arranged on the left-hand side of the picture, whereas program steps that are executed in the backend are provided with even reference numbers and are arranged on the right-hand side of the picture.

In the backend, the program starts in a step S2, in which variables are initialized, for example.

In a subsequent step S4, the backend 20 is provided with a parking probability q for a parking segment for which parking probability should be checked hereafter. The program is subsequently continued in a step S6.

In step S6, the backend 20 retrieves parking information for the corresponding parking segment, by way of example from a database associated with the backend 20. The parking information comprises a number N of parking spaces within the parking segment as well as historical parking data from the parking segment. The program is subsequently continued in a step S8.

In step S8, the backend 20 determines a proportion p of vehicles 10 associated with the system 1 relative to a total number of vehicles within a predetermined area surrounding the parking segment. Registration statistics are retrieved for this purpose, by way of example. The program is subsequently continued in a step S10.

The system 1 can collect a broad basis of information by steps S2-S8. In step S10, a parking card that accurately describes how many parking spaces are available on a street segment as well as data on the parking behavior of as large a proportion as possible of all driving automobiles in a fixed area within a fixed period of time can thus be available to the system 1. Furthermore, in step S10, the system thus possesses information regarding what proportion of all vehicles is being observed within the selected area and period of time. Assuming that the proportion of the observed vehicles 10 within the selected area and period of time remains constant, the probability that a given vehicle is being observed can be inferred therefrom.

Initially, it can be inferred how high the probability is that K' parked automobiles are being observed, given that N parking spaces are available in a parking segment, a given automobile is being observed with probability p, and the probability that a parking space is occupied is q. This probability follows a double binomial distribution $$P(K' \mid N, p, q) = \binom{N}{K'}(pq)^{K'}(1-pq)^{N-K'}$$

and can be evaluated by classic test statistics, for example. As an alternative, the probability distribution can be specified using a Bayes' test. In an embodiment, the classic test statistic is subsequently taken as a basis.

The classic test statistic can be determined in various ways. Here, it can be noted that the product pq is very small in realistic cases, such that an approximation by normal distribution only reaches the desired accuracy at higher values of N. It is for this reason that the ex-ante probability $$P(K' > C \mid N, p, q) = \sum_{c=C+1}^{N} P(K' = c \mid N, p, q) = \sum_{c=C+1}^{N} \binom{N}{c}(pq)^{c}(1-pq)^{N-c}$$

is subsequently determined, given that K' exceeds an upper limit C. As previously mentioned, the values for N and p are known. The value to be tested is q.

For the ex-ante probability P(K'>C|N, p, q) a threshold value $\alpha$ can be specified that a provider of the parking probability q and the operator of the system 1 can agree on in advance, for example. By way of example, $\alpha$=5%. The upper limit C is selected such that the probability of observing a value K' above C is only $\alpha$, i.e. C=min $\{c \in \{1, 2, \ldots, N\}: P(K'>c|N, p, q) \leq \alpha\}$.

The selected value for C is the upper limit in the case of which the parking probability q provided is deemed plausible. If, when determining the K number of vehicles 10 actually parked, a value K' is determined that exceeds the upper limit C, it can be concluded that the actual probability that a given parking space is occupied must be higher, since our observation is not plausible.

Formally, in other words, the hypothesis $H_0$ is tested that the actual probability R is below the indicated probability q. $\alpha$ is an upper limit for the probability that $H_0$ is incorrectly rejected, given that $H_0$ is true. The upper limit C is selected such that, if $\bar{q} \leq q$, the probability of a value for K being determined that exceeds the upper limit C is less than a percent.

In step S10, depending on the parking information and the determined proportion p, the backend 20 determines whether the parking probability q to be checked is plausible. For this purpose, depending on the parking information and the determined proportion p, the upper limit C is firstly determined according to C=min $\{c \in \{1, 2, \ldots, N\}: P(K'>c|N, p, q) \leq \alpha\}$, in the case of which a probability P that a K' number of the observed parked vehicles 10 exceeds the upper limit C is less than or equal to the threshold value $\alpha$, wherein $$P(K' > C \mid N, p, q) = \sum_{c=C+1}^{N} P(K' = c \mid N, p, q) = \sum_{c=C+1}^{N} \binom{N}{c}(pq)^{c}(1-pq)^{N-c}.$$

The program is subsequently continued in a step S12.

In step S12, depending on the upper limit C, the backend 20 determines whether the parking probability q to be checked is plausible. For this purpose, the backend 20 first determines the K number of vehicles 10 associated with the system 1 that are currently parked in the parking segment. For this purpose, in an embodiment, an inquiry is initially sent in step S12 to the vehicles 10 associated with the system 1 via the communication interface 22, 12. In an embodiment, the program is subsequently continued in a step S13 that takes place in the vehicle.

In step S13, each of the vehicles 10 checks whether it is in a parking state, by way of example using movement data. If this is the case, in an embodiment, the program is subsequently continued in a step S15 that takes place in the vehicle. Otherwise, the respective vehicle 10 can accordingly indicate to the backend 20 that it is not in a parking state and/or terminate the program related to the corresponding non-parked vehicle 10, for example.

In step S15, each of the parked vehicles 10 determines its current parking position and sends it to the backend 20 via the communication interface 12, 22. In an embodiment, the program is subsequently continued in a step S16 that takes place in the backend.

It is also conceivable that parking inquiries according to step S12 are only sent to such vehicles 10 known to be located in the predetermined area surrounding the parking segment. Alternatively, when registering a parking process, it is also conceivable that the vehicles 10 in turn actively indicate the corresponding parking position to the backend 20 without parking inquiries from the backend 20 according to step S12.

In step S16, depending on the parking positions indicated by the vehicles 10, the backend 20 finally determines the K number of vehicles 10 parked in the parking segment. Depending on the upper limit C and the determined K number, the backend 20 subsequently determines whether the parking probability q to be checked is plausible. The program is subsequently concluded, by way of example.

As already mentioned above, the probability distribution can be specified also using a Bayes' test. Here, a very broad probability distribution of the actual value $\bar{q}$, is adopted. This is adjusted according to the Bayes' theorem due to the new information from observing K. Confidence intervals, i.e. areas where q should be reported as plausible, can subsequently be specified on the basis of the exact probability distribution of $\bar{q}$ after observing K. It can be assumed that this procedure results in narrower confidence intervals and, as a result, shows parking probabilities as implausible more quickly.

In conclusion, the system or method according to the present subject matter involves testing, given a large number of observed automobiles, whether parking probabilities are correct. A parking card and a particularly large number of observed automobiles are used for this purpose. Within a fixed area and period of time, it is also assumed that the probability that a given automobile is being observed is constant. The classic statistical test falsely rejects the null hypothesis that the probability indicated is only true in a percent of cases, so that it is more likely to be enforceable in court and for recourse claims. However, the Bayes' test calls for stricter hypotheses and probably leads to more frequent rejections.

LIST OF REFERENCE NUMBERS

10 Vehicle
11 Control unit

12 Communication interface
13 Locator
20 Backend
21 Control unit
22 Communication interface
S2-S16 Program steps The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for operating a system for checking parking probabilities, wherein the system comprises a plurality of vehicles and a backend, the method comprising:

a) providing the backend with a parking probability q to be checked for a parking segment within a predetermined area;

b) providing the backend with parking information for the parking segment, the parking information representing a number N of parking spaces within the parking segment;

c) determining a proportion p of vehicles associated with the system from a total number of vehicles within the predetermined area;

d) determining a K number of vehicles that are associated with the system and parked in the parking segment; and e) determining whether the parking probability q is plausible, depending on the parking information, the K number of vehicles associated with the system and parked in the parking segment, and the determined proportion p.

2. The method according to claim 1, wherein the parking information comprises historical parking data.

3. The method according to claim 1 further comprising:

determining an upper limit C when a probability P is less than or equal to a predetermined threshold value α, depending on the parking information and the determined proportion p; and determining whether the parking probability q is plausible depending on the upper limit C and the K number of vehicles associated with the system and parked in the parking segment, wherein the probability P is that a K' number of vehicles associated with the system and parked in the parking segment exceeds the upper limit C.

4. The method according to claim 3, wherein the probability P that the K' number of vehicles associated with the system parked in the parking segment exceeds the upper limit C is calculated by the following formula:

$$P(K' > C \mid N, p, q) = \sum_{c=C+1}^{N} P(K' = c \mid N, p, q) = \sum_{c=C+1}^{N} \binom{N}{c} (pq)^c (1 - pq)^{N-c}.$$

5. The method according to claim 3, wherein the upper limit C is calculated by the following formula:

$$C = \min\{c \in \{1,2, \ldots ,N\} : P(K' > c \mid N,p,q) \leq \alpha\}.$$

6. The method according to claim 4, wherein the upper limit C is calculated by the following formula:

$$C = \min\{c \in \{1,2, \ldots ,N\} : P(K' > c \mid N,p,q) \leq \alpha\}.$$

7. The method according to claim 1, further comprising:

determining a probability distribution $\tilde{Q}$ that represents an estimated distribution of the actual parking probability $\bar{q}$, depending on the parking information and the determined proportion p;

determining an adjusted probability distribution $\overline{Q}$ according to Bayes' theorem, depending on the estimated probability distribution $\tilde{Q}$ and the determined K number; and determining at least one confidence interval in which the parking probability q is determined plausible, depending on the adjusted probability distribution $\overline{Q}$.

8. The method according to claim 2, further comprising:

determining a probability distribution $\tilde{Q}$ that represents an estimated distribution of the actual parking probability $\bar{q}$, depending on the parking information and the determined proportion p;

determining an adjusted probability distribution $\overline{Q}$ according to Bayes' theorem, depending on the estimated probability distribution $\tilde{Q}$ and the determined K number; and determining at least one confidence interval in which the parking probability q is determined plausible, depending on the adjusted probability distribution $\overline{Q}$.

9. A system for checking parking probabilities comprising:

a plurality of vehicles;

a backend;

a processor;

a memory in communication with the processor, the memory storing a plurality of instructions executable by the processor to cause the system to:

a) provide the backend with a parking probability q to be checked for a parking segment within a predetermined area;

b) provide the backend with parking information for the parking segment, the parking information representing a number N of parking spaces within the parking segment;

c) determine a proportion p of vehicles associated with the system from a total number of vehicles within the predetermined area;

d) determine a K number of vehicles that are associated with the system and parked in the parking segment; and e) determine whether the parking probability q is plausible, depending on the parking information, the K number of vehicles associated with the system and parked in the parking segment, and the determined proportion p.

10. The system according to claim 9, wherein the parking information comprises historical parking data.

11. The system according to claim 9, further comprising instructions executable by the processor to cause the system to:

determine an upper limit C when a probability P is less than or equal to a predetermined threshold value α, depending on the parking information and the determined proportion p; and determine whether the parking probability q is plausible depending on the upper limit C and the K number of vehicles associated with the system and parked in the parking segment, wherein the probability P is that a K' number of vehicles associated with the system and parked in the parking segment exceeds the upper limit C.

12. The system according to claim 11, in which the probability P that the K' number of vehicles associated with the system parked in the parking segment exceeds the upper limit C is calculated by the following formula:

$$P(K' > C \mid N, p, q) = \sum_{c=C+1}^{N} P(K' = c \mid N, p, q) = \sum_{c=C+1}^{N} \binom{N}{c} (pq)^c (1 - pq)^{N-c}.$$

13. The system according to claim 11, wherein the upper limit C is calculated by the following formula:

$$C = \min\{c \in \{1,2, \ldots ,N\} : P(K' > c \mid N,p,q) \leq \alpha\}.$$

14. The system according to claim 9, further comprising instructions executable by the processor to cause the system to:

determine a probability distribution $\tilde{Q}$ that represents an estimated distribution of the actual parking probability $\overline{q}$, depending on the parking information and the determined proportion p;

determine an adjusted probability distribution $\overline{Q}$ according to Bayes' theorem, depending on the estimated probability distribution $\tilde{Q}$ and the determined K number; and determine at least one confidence interval in which the parking probability q is determined plausible, depending on the adjusted probability distribution $\overline{Q}$.

15. A non-transitory computer-readable medium comprising instructions operable, when executed by one or more data processing devices in a system, to:

a) provide a backend with a parking probability q to be checked for a parking segment within a predetermined area;

b) provide the backend with parking information for the parking segment, the parking information representing a number N of parking spaces within the parking segment;

c) determine a proportion p of vehicles associated with the system from a total number of vehicles within the predetermined area;

d) determine a K number of vehicles that are associated with the system and parked in the parking segment; and e) determine whether the parking probability q is plausible, depending on the parking information, the K number of vehicles associated with the system and parked in the parking segment, and the determined proportion p.

16. The medium according to claim 15, wherein the parking information comprises historical parking data.

17. The medium according to claim 15 further comprising to:

determine an upper limit C when a probability P is less than or equal to a predetermined threshold value α, depending on the parking information and the determined proportion p; and determine whether the parking probability q is plausible depending on the upper limit C and the K number of vehicles associated with the system and parked in the parking segment, wherein the probability P is that a K' number of vehicles associated with the system and parked in the parking segment exceeds the upper limit C.

18. The medium according to claim 17, in which the probability P that the K' number of vehicles associated with the system parked in the parking segment exceeds the upper limit C is calculated by the following formula:

$$P(K' > C \mid N, p, q) = \sum_{c=C+1}^{N} P(K' = c \mid N, p, q) = \sum_{c=C+1}^{N} \binom{N}{c} (pq)^c (1 - pq)^{N-c}.$$

19. The medium according to claim 17, wherein the upper limit C is calculated by the following formula:

$$C = \min\{c \in \{1,2, \ldots ,N\} : P(K' > c \mid N,p,q) \leq \alpha\}.$$

20. The medium according to claim 15, further comprising instructions to:

determine a probability distribution $\tilde{Q}$ that represents an estimated distribution of the actual parking probability $\overline{q}$, depending on the parking information and the determined proportion p;

determine an adjusted probability distribution $\overline{Q}$ according to Bayes' theorem, depending on the estimated probability distribution $\tilde{Q}$ and the determined K number; and determine at least one confidence interval in which the parking probability q is determined plausible, depending on the adjusted probability distribution $\overline{Q}$.

* * * * *